United States Patent [19]
Armas
[11] 4,019,293
[45] Apr. 26, 1977

[54] BUILDING MODULES AND STRUCTURE EMBODYING SUCH MODULES

[76] Inventor: Eduardo Santana Armas, G.P.O. Box 3806, San Juan, P.R. 00936

[22] Filed: Jan. 27, 1975

[21] Appl. No.: 544,418

[52] U.S. Cl. ..... 52/79.11; 52/235; 52/236.5; 52/259; 52/429

[51] Int. Cl.² ..... E04B 1/348

[58] Field of Search ..... 52/79, 236, 234, 429, 52/235, 603, 323, 259, 283

[56] References Cited

UNITED STATES PATENTS

| | | | |
|---|---|---|---|
| 223,090 | 12/1874 | Arnold | 52/138 |
| 1,190,579 | 7/1916 | Pegg | 52/138 |
| 1,990,797 | 2/1935 | Olsen | 52/429 |
| 2,208,589 | 7/1940 | Leemhuis | 52/236 |
| 2,645,114 | 7/1953 | Amirikian | 52/236 |
| 3,148,477 | 9/1964 | Bjorn | 52/79 |
| 3,416,273 | 12/1968 | Stucky | 52/79 |
| 3,514,910 | 6/1970 | Comm | 52/79 |
| 3,596,417 | 8/1971 | Zachry | 52/236 |
| 3,683,577 | 4/1972 | Spillman | 52/258 |
| 3,722,152 | 3/1973 | Schlatter | 52/79 |
| 3,751,864 | 8/1973 | Berger | 52/79 |
| 3,849,952 | 11/1974 | Hanaoka | 52/79 |

FOREIGN PATENTS OR APPLICATIONS

| | | | |
|---|---|---|---|
| 54,096 | 5/1947 | France | 52/594 |
| 1,269,080 | 7/1961 | France | 52/79 |
| 1,518,637 | 2/1968 | France | 52/79 |
| 1,390,510 | 1/1965 | France | 52/234 |
| 2,076,803 | 10/1971 | France | 52/79 |
| 42,448 | 9/1907 | Switzerland | 52/594 |
| 772,834 | 4/1957 | United Kingdom | 52/236 |
| 985,338 | 3/1965 | United Kingdom | 52/79 |

*Primary Examiner*—Price C. Faw, Jr.
*Assistant Examiner*—Henry Raduazo
*Attorney, Agent, or Firm*—Synnestvedt & Lechner

[57] ABSTRACT

A preformed building module is disclosed, the module having a roof or top wall and four upright side walls, the latter having stud-like reinforcing elements, the roof, walls and studs being integrally cast of concrete. The modules are adapted to be associated with each other in the construction of a building.

There is also disclosed a building structure embodying modules of the kind described above and further embodying facade walls or panels covering one or more of the module side walls and having spaced upright stud elements interleaved with the studs of the side walls, and still further having a roof overhang.

25 Claims, 17 Drawing Figures

Fig. 8.
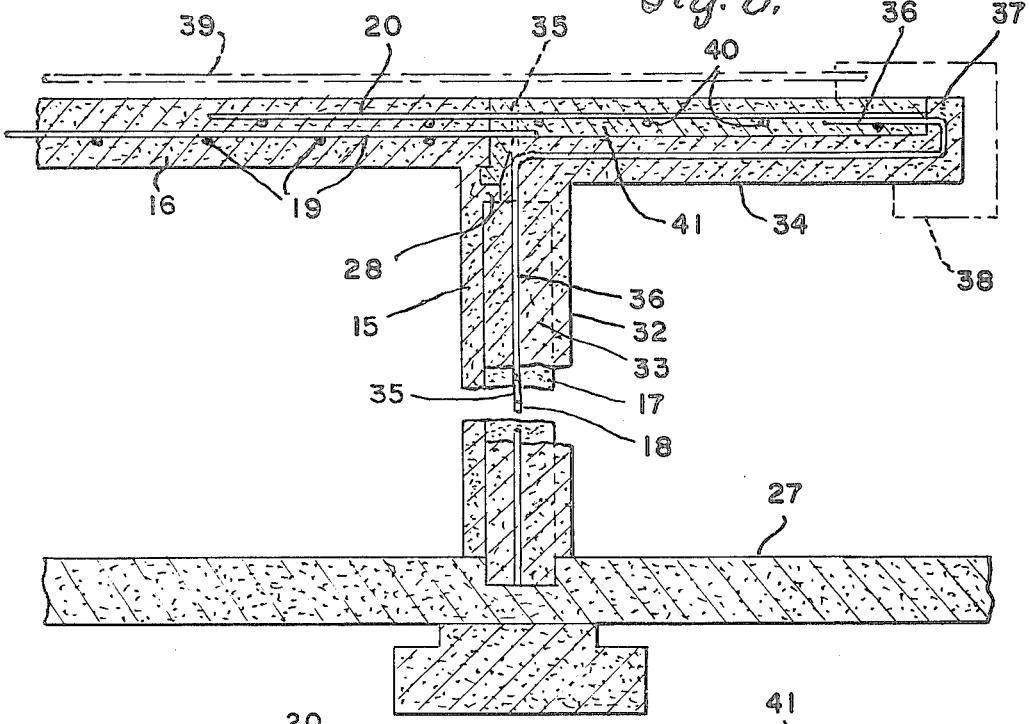
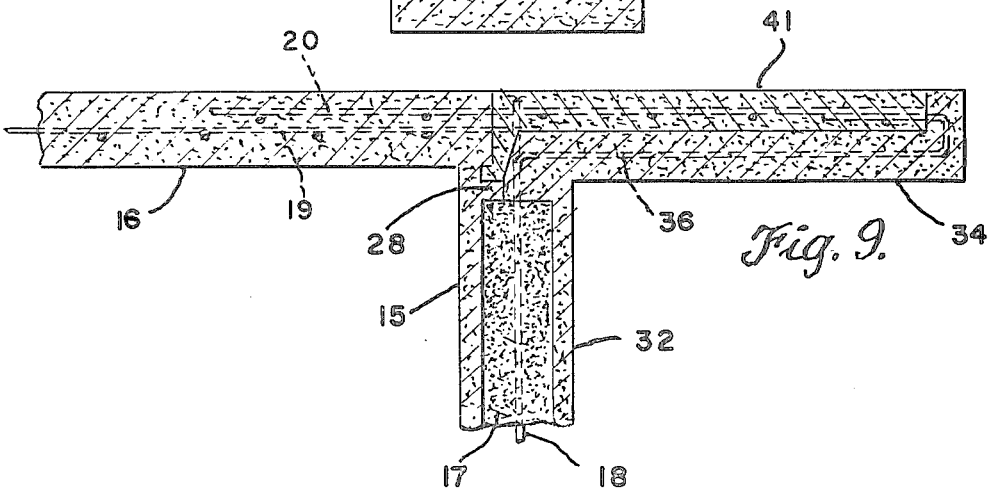
Fig. 9.
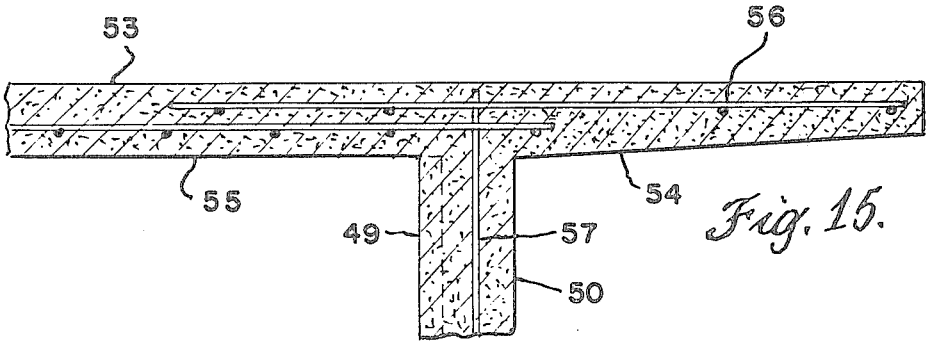
Fig. 15.
Fig. 16.
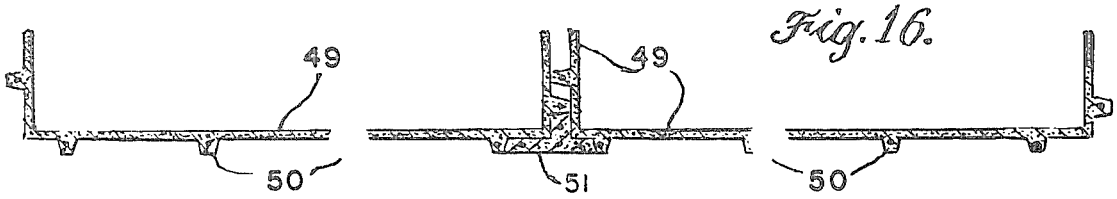

BUILDING MODULES AND STRUCTURE EMBODYING SUCH MODULES

BACKGROUND AND OBJECTS

The present invention is concerned with a novel form of building module and a novel building structure embodying such modules.

One of the general objects of the present invention is the provision of building modules arranged to facilitate preforming of such modules under factory manufacturing conditions, the modules being of such size and shape as to be capable of ready transportation from the factory or plant where they are manufactured to the building site.

Various prefabricated building units are already known, particularly where such units are fabricated by assembly of various components, the assembly usually providing for the prefabrication of subassemblies such as walls, which subassemblies are then transported to the building site and are assemblied to form the building structure, including the various rooms of the desired building being constructed.

In contrast with such prior prefabrication of subassemblies, the present invention contemplates a preformed module in the form of a cast concrete structure embodying a roof and four side walls. Preferably these modules are each of dimensions adapted to form a room in a building.

It is also an object of the invention to provide such precast modules in which the side walls are of relatively thin cast construction, but have studs or stud-like elements projecting from the outer surfaces of the side walls in order to provide appropriate side wall reinforcement, and for other purposes as will appear.

It is also an object of the invention to provide a precast module of the kind referred to in which the top wall may serve either as a roof in a one story building or as a floor for the second story of a two story building. The "roof" wall comprises a slab of cast concrete, preferably with steel reinforcing rods or the like, so that the roof will have adequate strength regardless of whether a second story is built upon the first.

Another object of the invention is to provide facade panels adapted to be used in association with the modules referred to and being of greater horizontal dimensions than the horizontal dimension of the side walls of the module to which the facade panel is applied, so that when facade panels are applied to adjoining walls of a module, the corner of the module is enclosed and a vertical cavity is provided at said corner adapted to receive concrete which may be cast at the site of construction of the building, thereby providing a structural post at the module corner.

Still further, it is an object of the invention to provide a roof overhang formed as a part of the facade panel, provision being made for a cast concrete joint between the upper edge of a module side wall and the facade panel associated with that wall, thereby unifying the structure.

It is a further object of the invention to provide modules with upper edge portions shaped so that when two modules are brought together in side by side relation, a horizontal cavity is provided between them adjacent to the roof, in which concrete may be cast, thereby providing a structural beam.

It is a further object of the invention to provide modules adapted for use in a multiple story building structure in which the surfaces defining the cavities for casting the horizontal beams are configured to provide for the casting of horizontal beams of greater cross sectional dimensions along the upper edges of the modules of the lowermost story, the horizontal cavities for forming the beams for the upper stories being shaped to provide horizontal beams of progressively reduced cross sectional dimensions.

BRIEF DESCRIPTION OF DRAWINGS

How the foregoing objects and advantages are attained will appear more fully from the following description referring to the accompanying drawings:

FIG. 8 is a vertical sectional view through one of the modules and an associated facade wall taken as indicated by the section line 8—8 on FIG. 5;

FIG. 9 is a similar vertical sectional view taken as indicated by the section line 9—9 on FIG. 5;

FIGS. 15 and 16 respectively illustrate fragmentary horizontal and vertical sectional views of portions of an alternative construction.

DETAILED DESCRIPTION OF THE DRAWINGS

The construction of the modules provided according to the present invention will first be described with particular reference to FIGS. 1 to 4 inclusive. Each module is made up of four side walls 15 and a roof slab 16. Each side wall is provided with series of vertical studs 17 spaced from each other and projecting outwardly from the outside surface of the side wall 15. The side walls, roof and studs of each module are desirably integrally cast of concrete and certain reinforcement elements such as wire, wire mesh and/or steel reinforcement rods are desirably incorporated in the studs, in the walls and in the roof. Door frames or door jambs are also preferably cast integrally with the other major elements of the modules. The stud reinforcements appear in FIG. 3 at 18 and the roof reinforcements include the elements indicated at 19 in FIG. 4 and also certain other elements described hereinafter in connection with FIG. 8. Preferably, the side walls 15 of the modules are relatively thin, for instance of the order of about 1 inch or 2½–4 centimeters in thickness, and the roof slab 16 is desirably of the general order of at least twice or three times the thickness of the side walls, for instance, 3½–4 inches or 8–10 centimeters.

In the foregoing description and in the description which follows, it is pointed out that where reference is made to the casting of the modules or other parts of concrete, it is to be understood that any appropriate cementitious materials may be employed, preferably concrete type incorporating crushed stone or aggregate. Reinforcement elements may also take a variety of forms, including especially steel rods, but certain forms of metal mesh may be utilized as will be apparent.

It is also to be noted that in much of the description and also in the claims, reference is made to the roof of the module, and it is to be understood that this term comprehends the top slab of the module in a single story building and also also comprehends the top slab even in instances where the top roof slab is employed as a floor for a story of the building superimposed upon the first. Where the top slab is employed as a floor for an upper story of a building, it is preferred to cast a special flooring layer integrally with the slab as is further pointed out herebelow with reference to FIG. 13.

Figure 2:
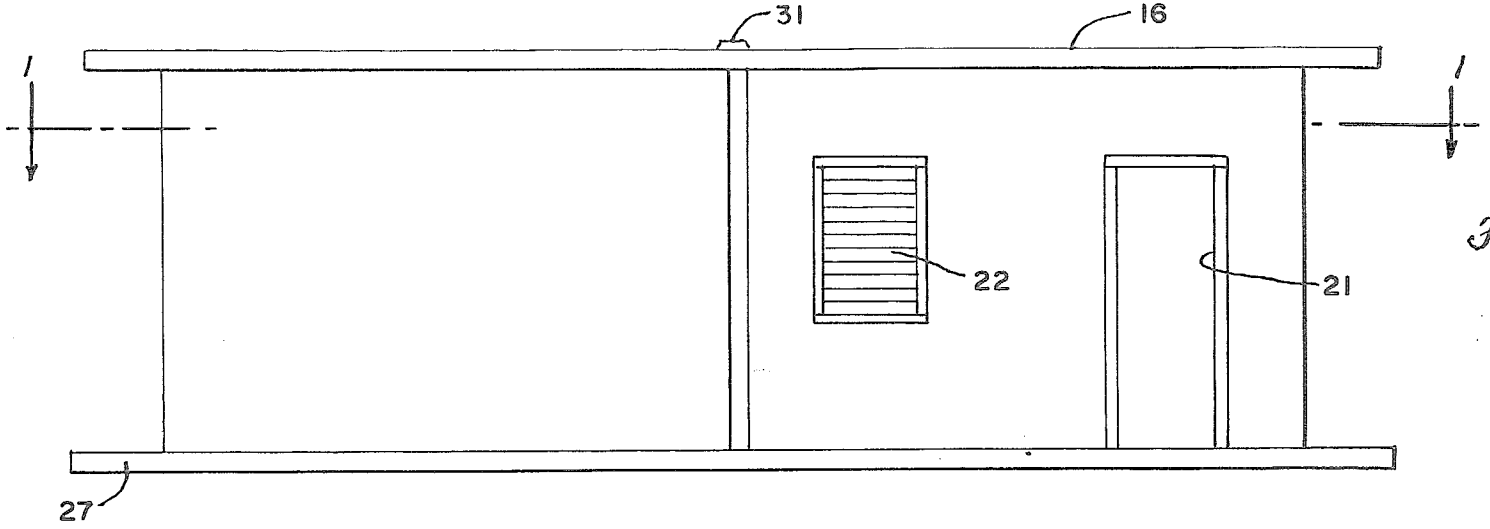
FIG. 2 is an elevational view of one side of the building shown in section in FIG. 1.
Figure 4:
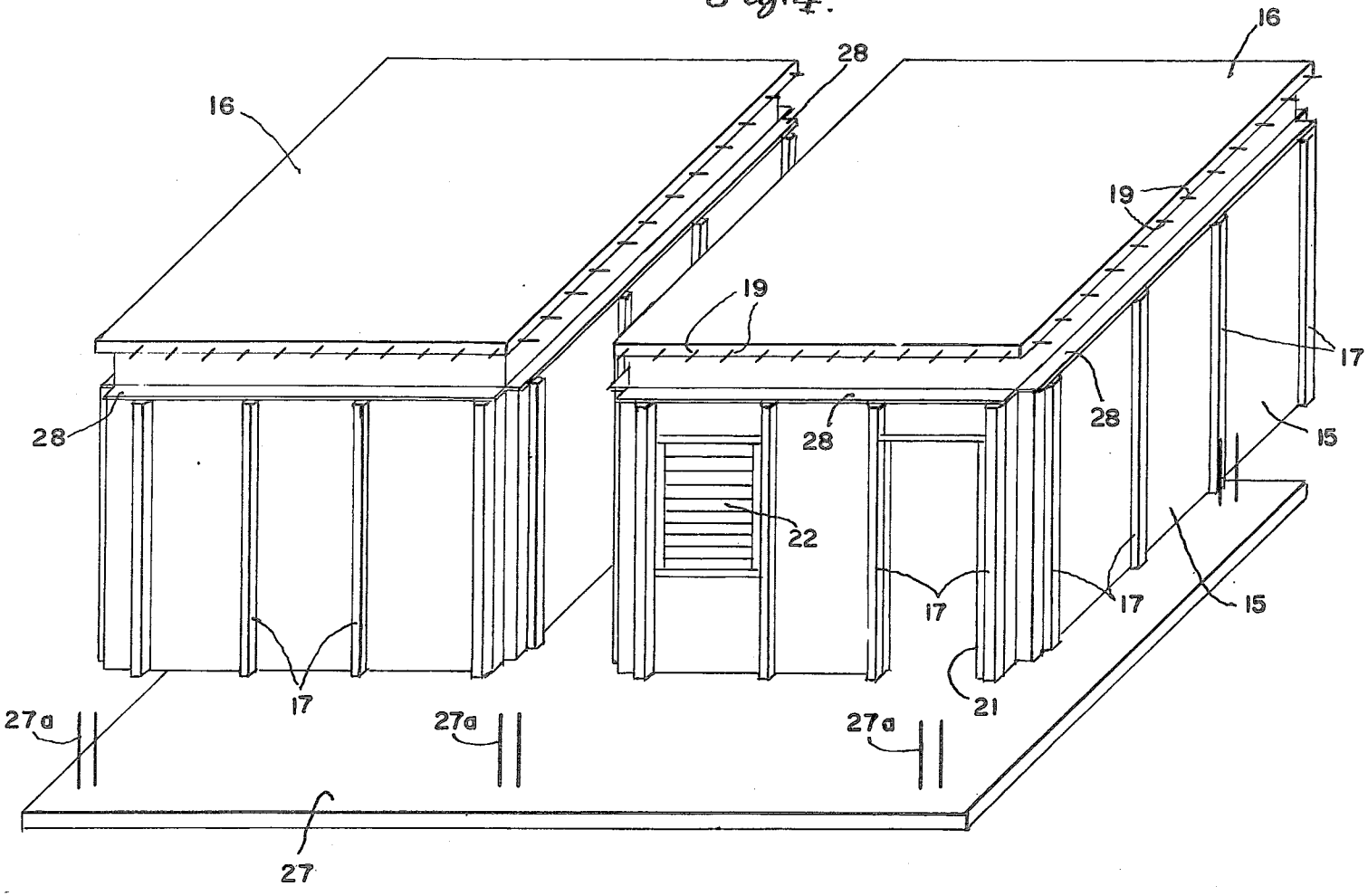
FIG. 4 is a somewhat diagrammatic isometric view of two modules according to the invention being brought into positions adjoining each other for mounting upon a foundation slab.

With regard to the structure of the module and also to the illustration thereof in the drawings, it is to be understood that openings for windows and doors, both internal and external, may be provided, preferably between adjacent studs in the walls. Examples of such doorways are shown in FIGS. 2 and 4 and it is preferred that the door frame itself be cast integrally with the wall of the module, so that the door hinges and hardware may be applied without the necessity for separately applying door frames at the building site. This has the further advantage that since the door frame is cast concrete it is resistant to weathering, fungus and insects and therefore has long life. Door frames are of course of such width as to span the entire wall thickness at the door location.

Examples of jalousie type windows are indicated at 22 in FIGS. 2 and 4. The presence or absence of such doorways, windows or the like either in external or internal walls of the building does not alter the features of construction of the remaining parts of the modules according to the present invention, and the lack of illustration of various of such doorways and windows in either the interior or the exterior walls of the building shown in the drawings, and the absence of reference to such doorways and windows in the claims is not to be understood as excluding the presence thereof.

Figure 1:
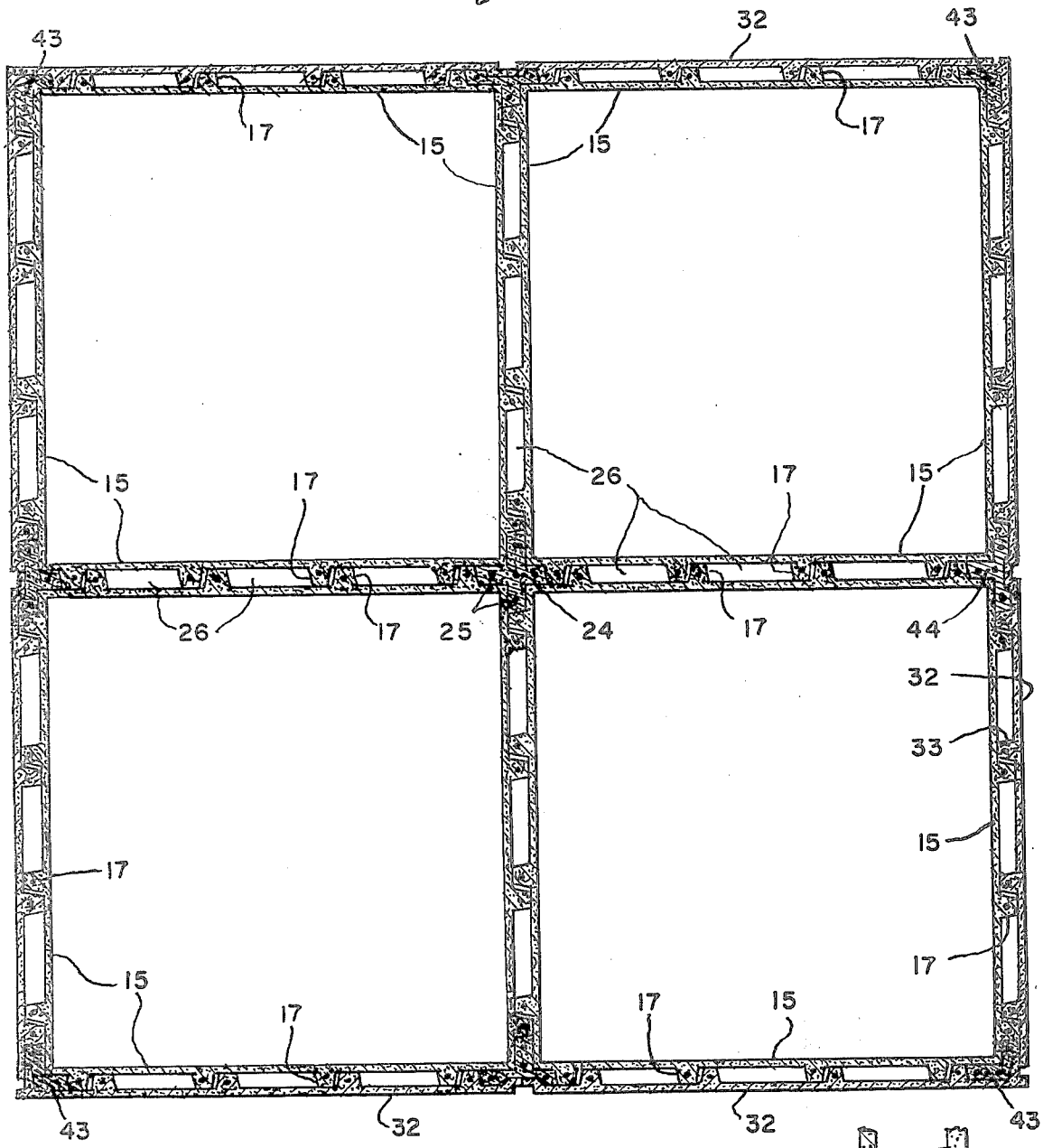
FIG. 1 is a horizontal sectional view taken as indicated by the section line 1—1 on FIG. 2 and illustrating a building structure embodying four of the modules constructed according to the present invention and having facade panels at all of the exterior surfaces of the building.
Figure 3:
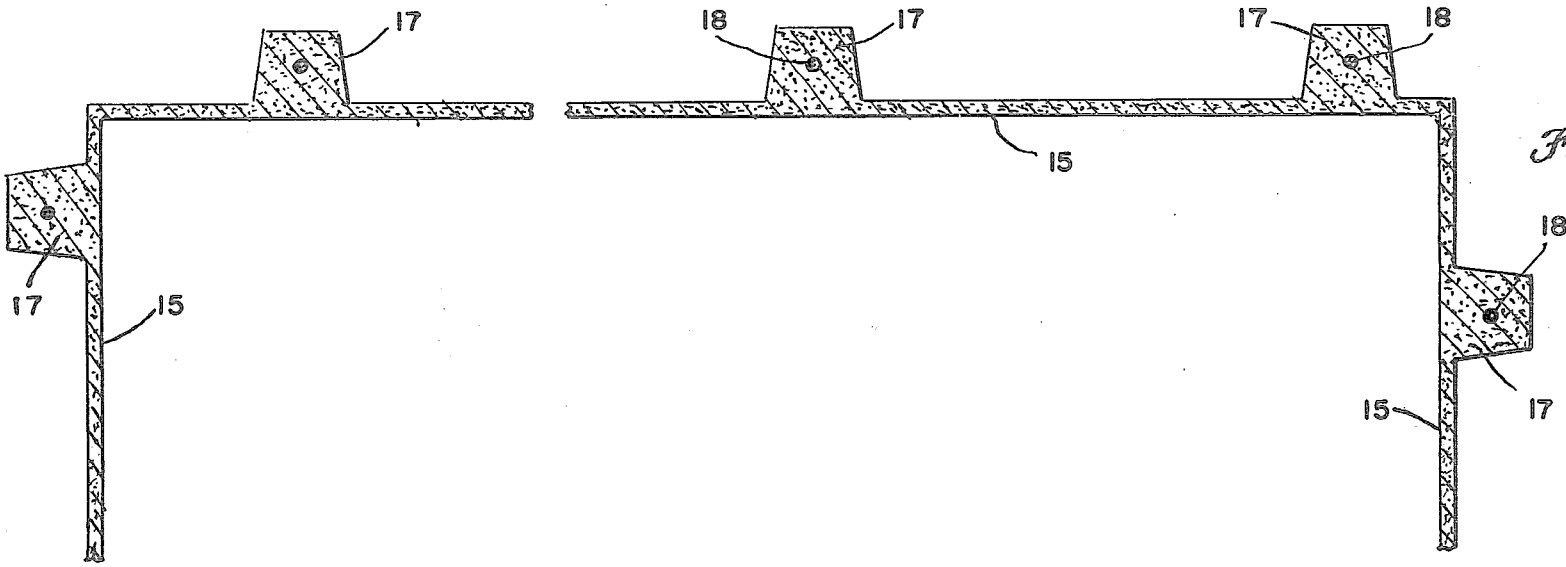
FIG. 3 is an enlarged fragmentary horizontal sectional view through a portion of one of the modules embodied in the structure of FIGS. 1 and 2.
Figure 5:
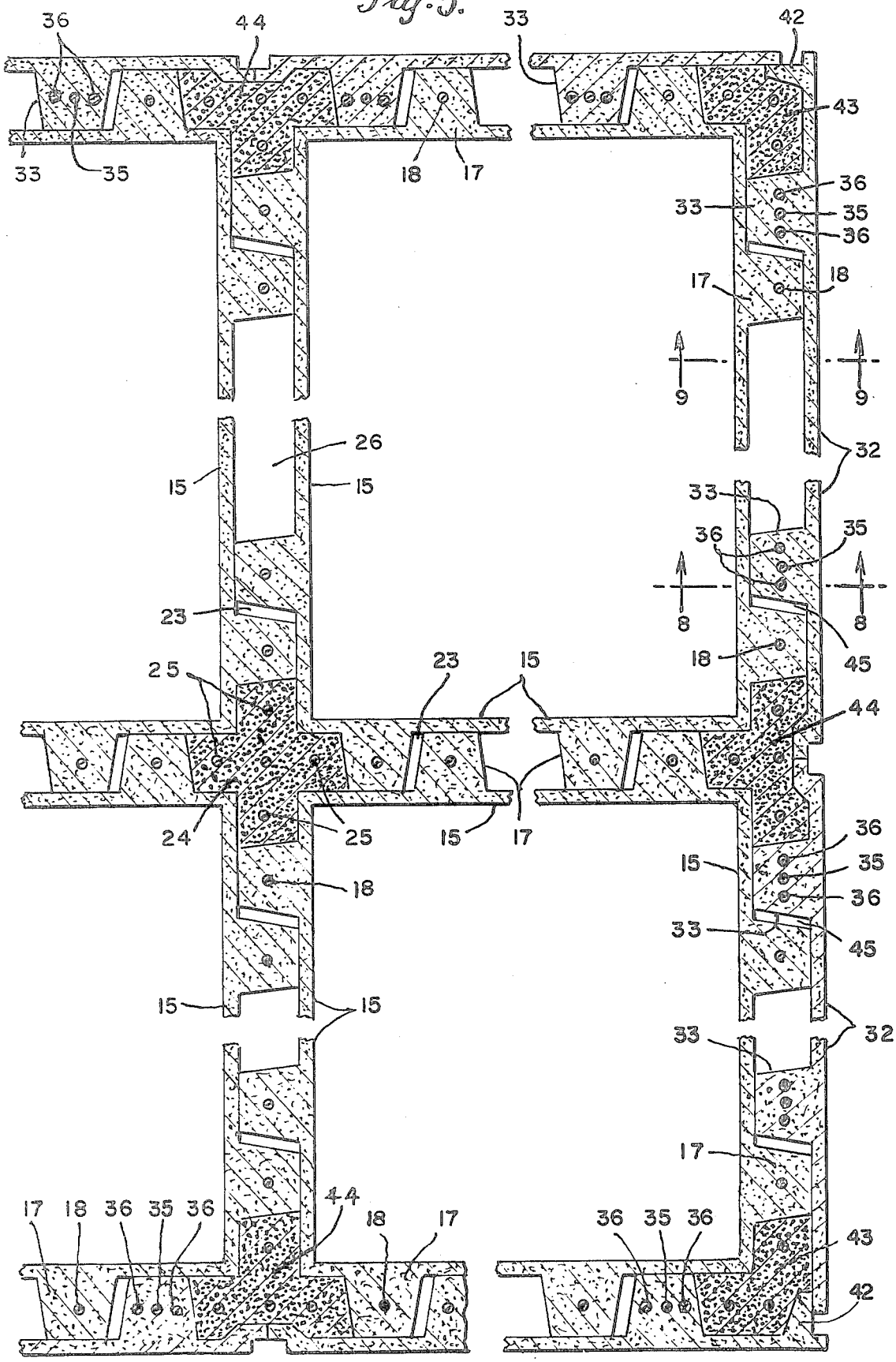
FIG. 5 is an enlarged fragmentary sectional view of the structure of FIGS. 1 and 2, this view being taken in the same manner as FIG. 1, i.e. as a horizontal section through FIG. 2, but the illustration in FIG. 5 being on a larger scale with portions being broken out, and particularly illustrating the manner in which the studs of the module side walls and the studs of the facade panels are interleaved and used to form various of the vertical structural posts.

Attention is now called to the fact that the series of studs associated with each wall of each module may comprise any desired number of studs, in the illustration of the drawings, four being shown. It is further to be noted that, as seen in FIGS. 1, 3 and 5, the studs 17 are distributed along each wall 15 so that the stud at one end of the series is closer to the adjacent corner of the module than is the stud at the other end of the series in relation to the corner at the other edge of that wall. Thus, as viewed in FIG. 3, the stud 17 at the right hand of the figure is closer to the right hand corner than the stud 17 at the left with respect to the left hand corner of the module. From FIG. 3, it will also be seen that on the adjoining walls of the module the stud 17 the right hand side of FIG. 3 has the greater spacing from the right hand corner and the stud 17 at the left hand side of the figure has the smaller spacing from the left hand corner. This relationship is provided serially around the perimeter of the module, and because of this, with modules of four equally dimensioned side walls, any two side walls may be brought into congruent face-to-face relation, and the studs 17 will interleave with each other, as is clearly apparent from FIG. 1 and also from the left central portion of FIG. 5. Preferably the positioning of the studs on the side walls is such as to provide slight spacing as indicated at 23 in FIG. 5, when module side walls are brought into congruent relationship with each other. The side faces of the studs are also desirably inclined toward each other and away from the wall of the module, in order to facilitate interleaving of the studs upon assembly.

From FIGS. 1 and 5, it will also be seen that when four modules of the kind described are assembled in a building structure of rectangular shape, the studs 17 adjacent to the adjacent corners of the modules define a cross-shaped vertical cavity adapted to receive concrete indicated at 24 which may be cast therein, preferably after insertion of reinforcement rods 25. This provides a vertical structural post contributing strength to the overall structure.

The employment of the series of spaced studs associated with each side wall of each module also provides interwall spaces, such as indicated in FIGS. 1 and 5 at 26 in which wiring and plumbing may be introduced and carried from floor to floor in a multi-story building.

Referring now particularly to FIG. 4, it will be seen that in a typical installation at a building site, an appropriate concrete foundation slab 27 may be provided, on which a group of the modules may be assembled and mounted. Preferably the foundation slab is formed with reinforcing elements including some indicated **27*a* which project upwardly and which are to be received in concrete to be cast in corner posts or posts positioned along the side walls of the structure at points where modules meet. Further reference to this appears herebelow particularly in the description of FIGS. 5 and 7.**

Modules such as shown in FIGS. 1 to 14 are basically configured so that they are adapted for use either as an interior module (i.e. surrounded on all sides by other modules) or as an exterior module (i.e. positioned in the building with one or more sides presented to the exterior of the building). Such modules may be provided with two series of reinforcement rods 19 and 20 (see particularly FIGS. 1A, 4, 8 and 9) projecting from the edges of the roof slab, rods 19 being short and rods 20 being long, for certain reinforcement purposes to be described.

In considering FIG. 4 it is to be kept in mind that each of the modules there shown have been prepared for use as an "inside" module, i.e., one which has no side wall presented to the exterior of the building. Thus the long reinforcement rods 20 have been deleted from all edges of the roof slabs but the rods 19 remain.

Figure 1A:
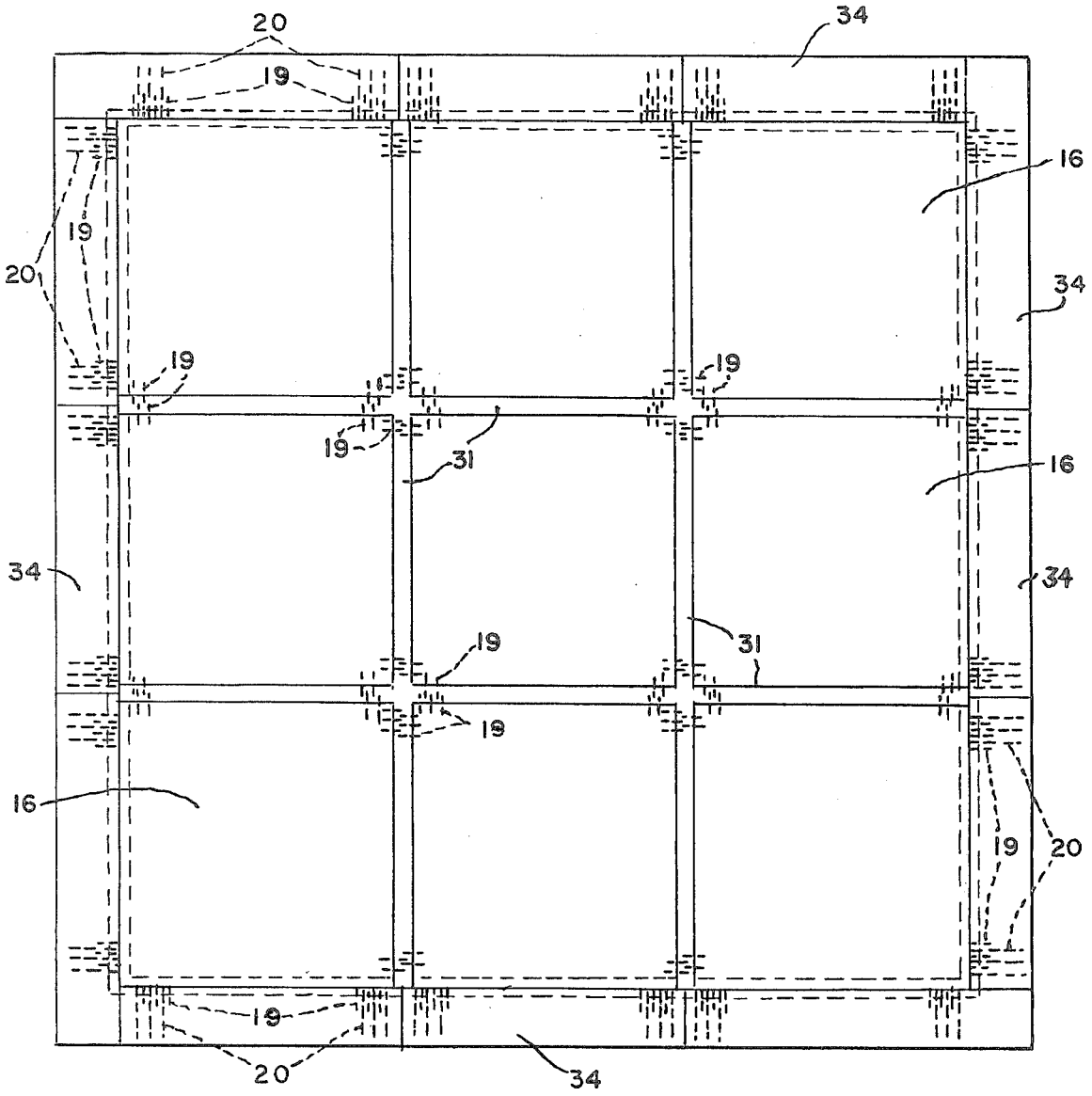
FIG. 1A is an outlined plan view of a building embodying nine modules.

In the plane view of FIGS. 1 and 1A, two different buildings are illustrated, the building of FIG. 1 comprising four modules each having two sides walls presented exteriorly of the building and two walls presented interiorly of the building. In FIG. 1A the central module there shown has all four sides prepared for interior use as in FIG. 4. In FIG. 1A there are also corner modules which, like all of the modules in FIG. 1 have two sides exteriorly presented and two sides interiorly presented. Still further, FIG. 1A uses four modules, each of which has one side exteriorly presented and three sides interiorly presented. In each case, it is contemplated that the long reinforcement elements 20 will be retained at the exterior walls and that the long rods will be deleted for the interior walls and used in the manner which will further appear. However, certain other constructional features of the modules are first considered just below.

Figure 11:
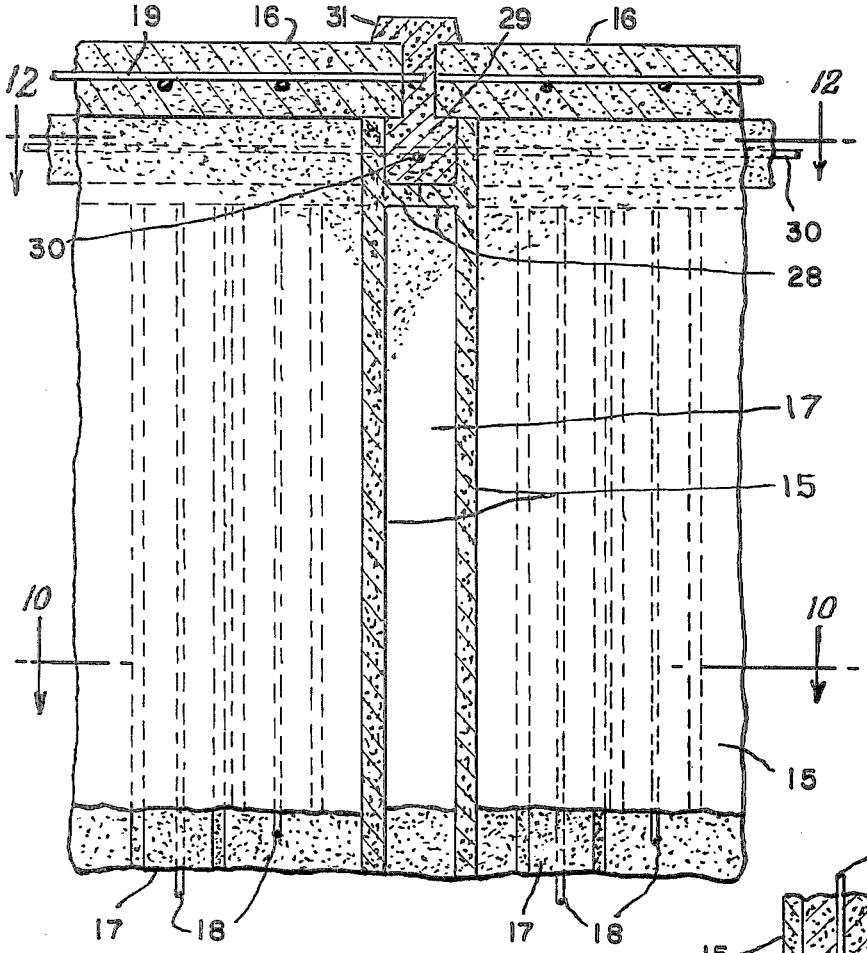
FIG. 11 is a vertical sectional view taken as indicated by the section line 11—11 on FIG. 10.
Figure 12:
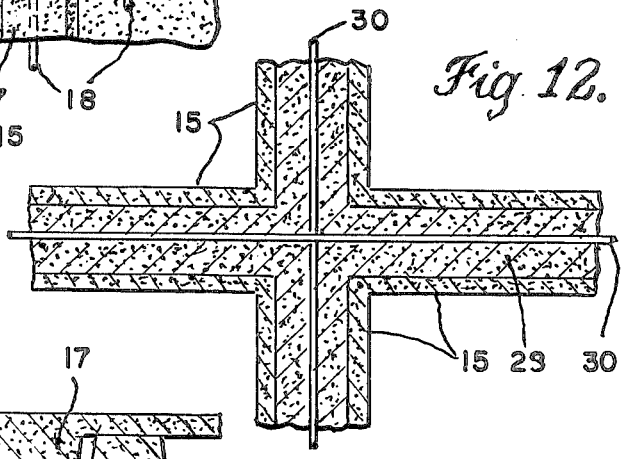
FIG. 12 is a fragmentary horizontal sectional view taken as indicated by the section line 12—12 on FIG. 11.
Figure 10:
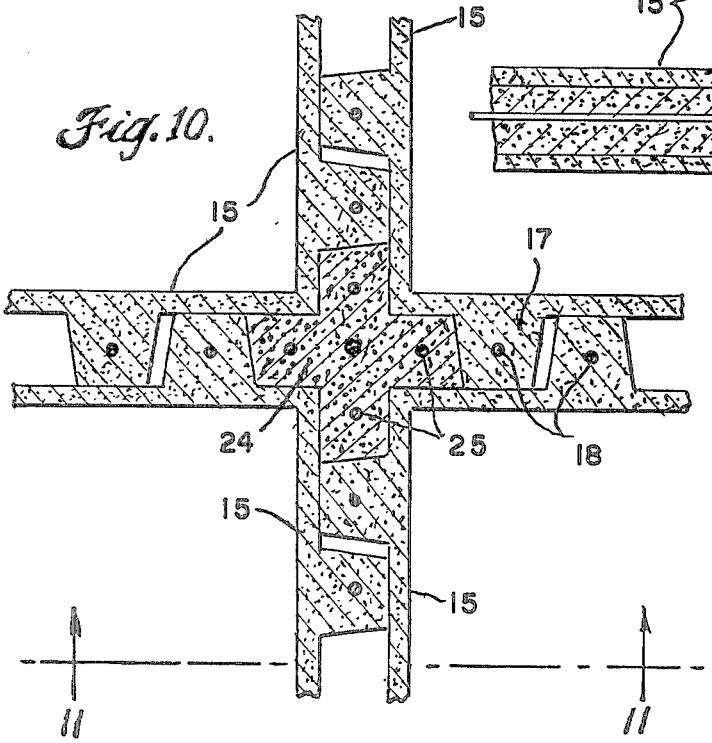
FIG. 10 is a fragmentary horizontal sectional view of a portion of the structure shown in FIG. 5, i.e. that portion in the region where four corners of four modules are brought together and showing also the vertical post which is cast in a cavity formed by the modules adjacent said four corners.

As seen in FIGS. 4 and 11 each module is provided, adjacent the upper end of studs 17, with a strip or flange 28 and these flanges are adapted to abut when two side walls of two modules are brought together. The free edge of the flanges or strips 28 extend outwardly from the side walls of the modules a distance greater than the free edges of the roof slabs 16. This arrangement provides a horizontal cavity running along the upper adjacent edges of a pair of assembled modules into which concrete may be cast as indicated at 29 in FIG. 11, reinforcing rods such as indicated at 30 again being used. As is shown in FIG. 11, this concrete may readily be cast by introducing the concrete through the space between the adjacent edges of the roof slabs 16. For the purpose of sealing against ingress of water, an enlargement 31 projecting above the top surface may be provided as a portion of the cast concrete 29. This arrangement provides for the casting of horizontally extended structural beams, which is not only important in providing for extensive support of the roof in a single story building, but is also of importance in providing adequate beams in a multi-story building as will be described later in reference to FIGS. 13 and 14. As will be seen in FIG. 11, the reinforcing rods 19 project into the concrete filling the space between the adjacent edges of adjacent roof slabs.

Attention is now directed to the fact that it is contemplated according to the present invention to employ facade walls or panels in association with modules which have been cast or formed for use with one or more sides presented to the exterior of the building as illustrated in FIGS. 1 and 1A. A typical facade wall for this purpose is isometrically shown in FIG. 7. This wall is preferably formed as a concrete casting and includes a wall or panel portion 32 having a series of spaced studs 33, four being here shown.

These studs are positioned so as to interleave with the studs 17 of the module walls when the facade walls are brought into congruent face-to-face relation with the module walls, this relationship being well illustrated in FIG. 5. The facade wall also has a roof overhang portion 34, so that when the facade wall is assembled with a side wall of a building module, the facade wall will not only provide a doubled exterior wall for the building, but will also provide a roof overhang. The studs 33 of the facade wall desirably have reinforcement elements or rods therein, as is shown particularly in FIGS. 5, 7, 8 and 9. A central reinforcing rod 35 is provided in each stud, and this rod extends upwardly to project as indicated in FIGS. 7 and 8. A pair of rods 36, one at each side of the rod 35, are provided and extend upwardly and thence laterally outwardly over the roof overhang being embedded in the flange 37 of the roof overhang and extended inwardly as shown in FIG. 7 and 8. In the assembly of the facade wall with a module, the parts are brought together as shown in FIGS. 5 to 8 and as indicated in FIG. 8 a holding device of U-shape, indicated in dot and dash lines at 38 is applied to the free edge of the roof overhang and held in position by means of the rod or cable at 39. Reinforcement elements 40 are then desirably applied over the roof overhang, and it should be noted that with the modules prepared for use with a side presented to the exterior of the building, the long reinforcement rods 20 remain and project over the roof overhang of the facade walls (see FIGS. 1A, 8 and 9). The outer ends of these reinforcement rods 20 are embedded in the concrete shown at 41 which is cast over the roof overhang 34 thus embedding all of the reinforcement elements 19, 35, 20, 36 and 40. This forms a joint between the facade wall and the module and unifies the structure. After setting of this concrete the temporary holding elements 38 and 39 may be removed.

It will be understood that a facade wall of the general kind shown in FIG. 7 may be cast in several alternative forms depending upon the position in which it is to be used in the building structure. For example, where one end of the facade wall will be positioned at a corner of the building, it may be desirable that the roof have an extension such as indicated at 34*a* adapted to cooperate with the overhang of a facade wall on the adjacent wall, in order to complete the roof overhang perimetrically around the corner of the building. Where the facade wall is to be used along other outside walls of a building, such a roof overhang extension 34*a* may not be needed.

As shown in FIG. 5, it is also desirable that the facade walls incorporate provision for expansion and contraction with relation to the walls of the module. This may be accomplished in several ways as by the lap joint indicated at both the lower right and upper right hand corners of FIG. 5. For example, at the lower right hand corner the facade wall 32 is provided with a lip 42 adapted to fit inside of the free edge of the adjacent facade wall 32, so that freedom for expansion and contraction is afforded between the facade walls and the module walls.

It will also be seen from FIG. 5 that the facade walls cooperate with the module walls and with the studs 17 and 33 to define vertical cavities in which concrete may be cast to form structural posts at the corners of the building, such as indicated at 43. Structural posts 44 may also be similarly cast in regions where an internal wall of the building meets an external wall of the building as at the central right hand portion of FIG. 5. The reinforcing elements 27*a* projecting upwardly from the foundation slab 27 are desirably positioned so that they will extend upwardly into the lower ends of the cast structural posts 43 and 44, thereby uniting the stucture of the building with the foundation slab.

With regard to the positioning and spacing of the studs on the facade wall, it is to be noted that such positioning and spacing is similar to that employed on the side walls of the module, but is arranged to provide for interleaving of the facade wall studs with the module wall studs, preferably with slight spacing between the studs of the two walls as indicated at 45 in FIG. 5.

Figure 6:
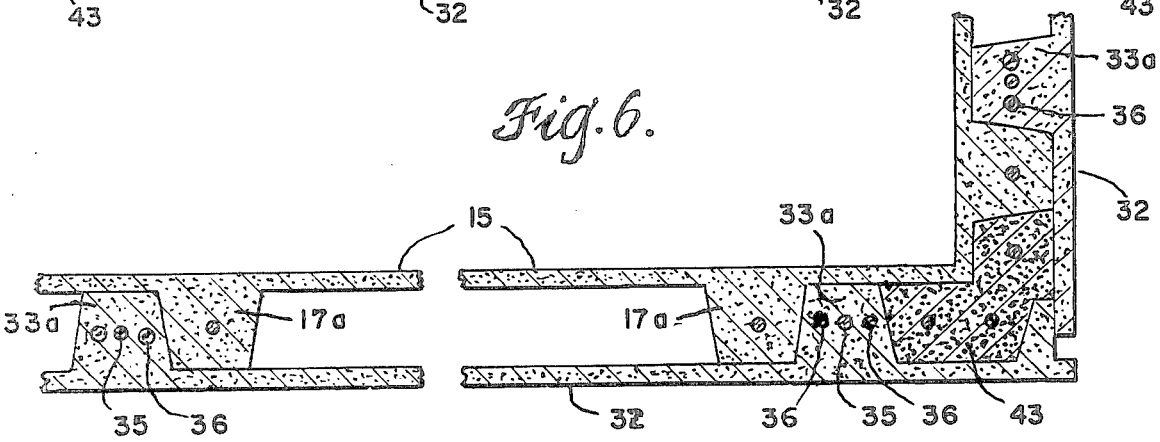
FIG. 6 is a fragmentary view of a portion of a construction similar to that shown in the lower right hand corner shown in FIG. 5 but illustrating an alternative positioning of the studs of the modules and of the facade panels.
Figure 7:
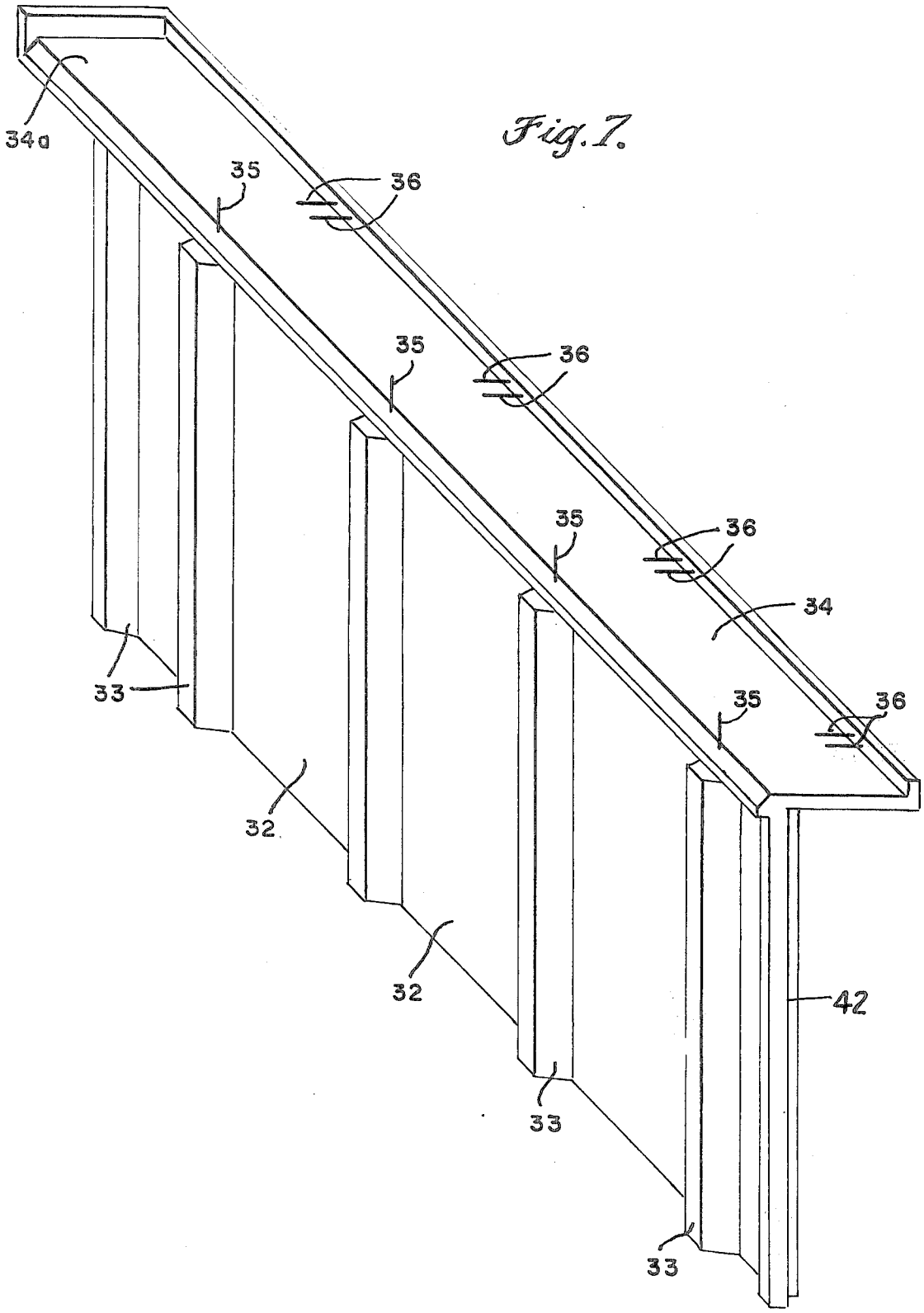
FIG. 7 is an isometric view of one of the facade panels embodied in the construction shown in FIGS. 1 to 5.

In a alternative arrangement, which is illustrated in FIG. 6, the studs 33*a* of the facade walls and the studs 17*a* of the module walls may be positioned so that the inclined side faces of the studs interengage as the facade and module walls are brought together. This may be desired in order to assure congruent positioning of the various wall elements. This system may also be utilized to provide interpositioning of two module wall when they are brought together to form an internal wall of the building.

Figure 13:
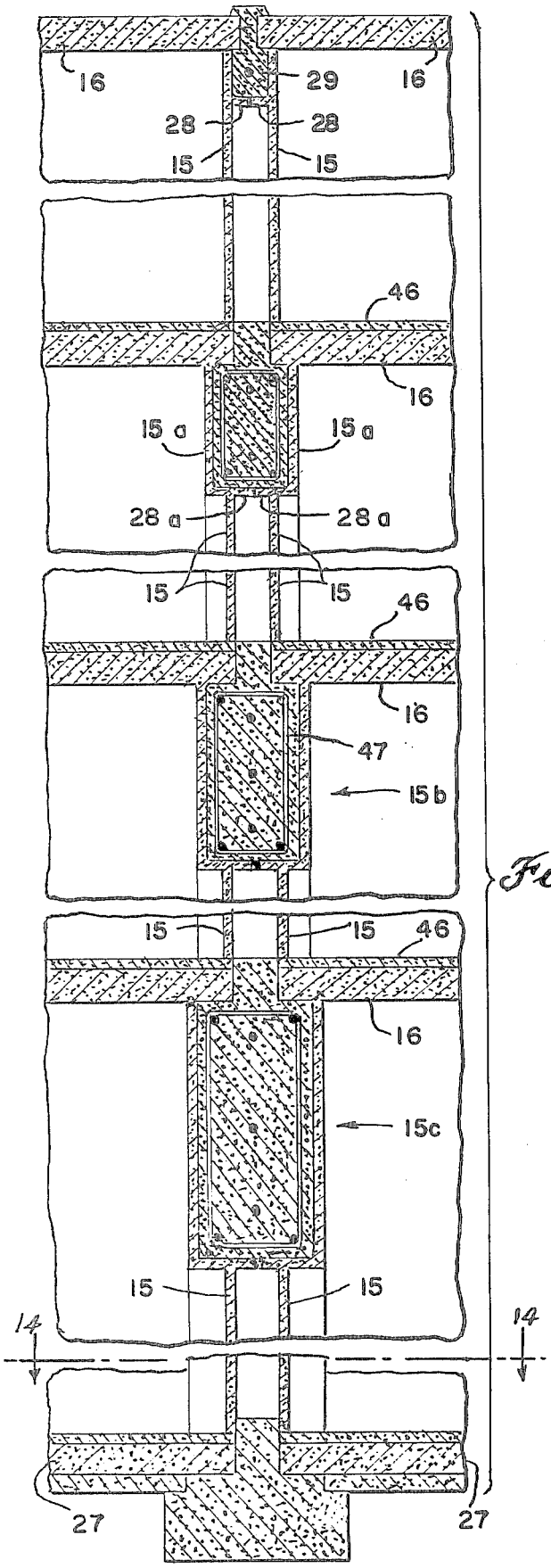
FIG. 13 is a vertical sectional view similar to the view of FIG. 11 but illustrating the construction of parts of four superimposed stories.
Figure 14:
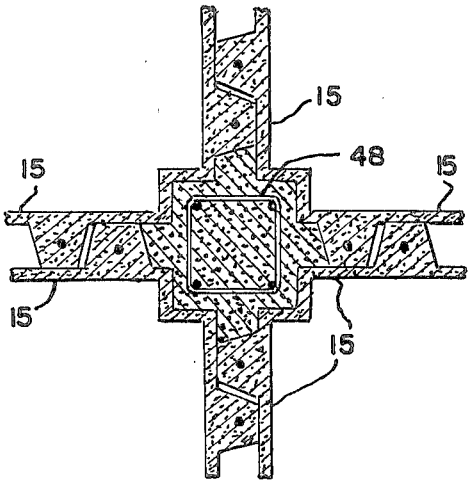
FIG. 14 is a horizontal sectional view taken as indicated by the section line 14—14 on FIG. 13.

Turning now to the construction shown in FIGS. 13 and 14, it is first noted that in FIG. 13, there is shown a vertical section similar to the section of FIG. 11 except that FIG. 13 shows the provision of appropriately sized horizontal beams in a multi-story building, four stories being illustrated in FIG. 13. In this figure the uppermost story corresponds to that shown in FIG. 11, although the section of FIG. 13 is taken at a position where only one of the intersecting cast beams 29 appears.

The next to the top story in FIG. 13 has flanges or lips 28*a* which are spaced downwardly from the roof slab 16 a greater distance than in the top story, and in addition the wall elements 15 a are differently positioned so as to define a larger horizontal cavity for receiving a larger casting of concrete, thereby forming a larger horizontal beam. Similarly the next story below that just described, as indicated generally at 15*b*, is arranged to provide a still larger horizontal beam and in the lowermost story as indicated at 15*c* the horizontal beam is still larger. Thus, it is contemplated that the modules for different stories or floors be configured to provide for the casting of horizontal beams with the largest being employed in the lowermost story and the smallest in the uppermost story. This is desirable for the purpose of providing for structural requirements for the building as a whole.

As seen in FIG. 13, it is also contemplated that where the roof slab 16 is to be employed as a support for flooring for a superimposed story of the building, some appropriate flooring material such as the granite slab indicated at 46 may be provided on the slab 16, preferably by casting in the factory. Other flooring material may also be used and certain coverings may also be applied after the construction of the building if desired.

It should also be noted that it may be desirable for a multi-story building to increase the size of the vertical posts or columns as compared with a single story building. An example of this is indicated in a horizontal sectional view in FIG. 14, which corresponds generally to FIG. 10 but shows a modified corner structure for the modules adapted to define a larger vertical cavity for receiving a larger structural post or column, providing additional strength for the multistory building. It will be understood that appropriate reinforcing elements may be introduced in various of these enlarged structural beams and posts, as indicated at 47 and 48.

The description above relating to FIGS. 1 to 14 inclusive deals with a form of construction in which it is contemplated that facade walls be associated with the external module walls. This is desirable for a number of reasons including better capability of insulation and also improved appearance of the building. However, it is contemplated that modules may be employed without the addition of facade walls, and a form of construction for this purpose is illustrated in FIGS. 15 and 16. This form of construction is also capable of providing still more economical housing as virtually the entire structure may be formed merely of the modules themselves. In FIG. 16, there is shown a fragmentary horizontal sectional view of a pair of adjacent modules having vertical walls 49, with studs 50. In this embodiment the studs may be positioned and spaced in various ways so as to interleave and provide spaces for casting of posts where desired. In one arrangement, a concrete post as indicated at 51 in FIG. 6 may be cast (using a temporary form). If desired an interior vertical post may be cast where four modules meet in central region of a building.

FIG. 15 illustrates in vertical section on an enlarged scale a fragment of an upper portion of a module constructed according to FIG. 16 and indicates a roof slab 53 having an overhang 54 directly and integrally molded with the entire module. Appropriate reinforcing elements such as indicated at 55 and 56 may be employed in the roof and in the roof overhang. Vertical reinforcing elements 57 extending through the studs 50 of the modules may also be provided.

According to the foregoing provision is made for utilizing factory type automation and fabrication techniques in the construction of cast concrete modules adapted to be transported from the factory to the building site and readily and quickly assembled without extensive labor and supplementary costs. The system of the invention also provides for construction of either single or multi-story buildings and while certain modifications of the basic module configuration may be preferred for specialized purposes, such modules may nevertheless be factory constructed and distributed to buildings sites even at some distances from the plant, because the modules may be proportioned to be readily transported by truck or by railcar.

I claim:

1. A building module comprising four upright side walls and a roof integrally cast of concrete, the roof having a planar top surface and the side walls being joined at corners and each having a series of equally spaced upright studs of greater thickness than the wall portions between the studs and projecting from the outer surfaces of the side walls, the stud at each end of the series on each of the four side walls being spaced from the end of that wall and the stud at one end of the series for each of the four side walls being spaced from the adjacent corner of the module a distance greater than the spacing of the stud at the other end of the series from the corner of the module adjacent said other end, thereby providing for interfitting of the studs of one side wall of the module with the studs of any side wall of a similar module when such side walls are congruently positioned with relation to each other.

2. A building module as defined in claim 1 and further having a horizontal flange along a wall of the module integrally cast with the wall near the upper edge of the wall but below the top of the module, the flange projecting outwardly beyond the edge of the roof and thereby provide, in cooperation with a similar flange on an adjacently positioned similar module, a channel which is upwardly open between the adjacent spaced edges of the roofs of adjacently positioned modules, thereby providing for casting concrete in said channel to form a structural beam.

3. A building module as defined in claim 2 in which the flange projects from the module wall a distance less than the projection of the interfitting studs.

4. A building module comprising four upright side walls and a roof integrally cast of concrete, the roof having a planar top surface and the side walls being joined at corners and each having spaced studs projecting outwardly from the walls and thereby provide for interleaving of the studs on one wall with similar studs on an adjacently positioned wall of a similar module, and each module having a horizontal flange spaced above the lower edge of the wall and located near the upper edge thereof but below the top of the module, the flange being integrally cast with the walls of the module and projecting outwardly beyond the edge of the roof a distance less than the projection of the studs but greater than any other part of the wall and thereby provide, in cooperation with an abutting similar flange on an adjacently positioned similar module, a channel having an opening presented upwardly between the adjacent spaced edges of the roofs of adjacently positioned modules, thereby providing for casting concrete through said opening into said channel to form a structural beam.

5. A building module as defined in claim 4 in which reinforcing elements are cast in the concrete of the roof and project from the edges of the roof.

6. A building structure including a building module comprising four upright side walls and a roof integrally cast of concrete, the side walls being joined at corners and each having a series of spaced upright studs projecting from its outer surface, and a separately formed facade wall of substantially the same height as the side walls of the module and covering at least one of the side walls of the module and having a series of spaced upright studs interleaved with the studs of the side wall, the facade wall being supported from the upper edge of the module with which it is associated.

7. A building structure as defined in claim 6, in which the facade wall and its studs are integrally cast of concrete.

8. A building structure as defined in claim 6 in which the facade wall has a roof overhang lying generally in the plane of the roof of the module.

9. A building structure including a building module comprising four upright side walls and a roof integrally cast of concrete, the side walls being joined at corners and each having a series of spaced upright studs projecting from its outer surface, and a separately formed facade wall of substantially the same height as the side walls of the module and covering at least one of the side walls of the module and having a roof overhang lying generally in the plane of the roof of the module, the facade wall being supported from the upper edge of the module with which it is associated.

10. A building structure as defined in claim 9 in which the roof of the module has reinforcement elements embedded therein and having portions projecting from the edge of the roof, the structure further including concrete cast as a joint between the roof of the module and the roof overhang of the facade wall, the projecting portions of the roof reinforcement elements being embedded in the concrete of said joint.

11. A building structure including a building module comprising four upright side walls and a roof integrally cast of concrete, the side walls being joined at corners and each having a series of spaced upright studs projecting from its outer surface, a separately formed facade wall of substantially the same height as the side walls of the module and covering at least one of the side walls of the module and having a series of spaced upright studs interleaved with the studs of the side wall, the facade wall having a roof overhang lying generally in the plane of the roof of the module, the facade wall, its studs and the roof overhang being integrally cast of concrete, and reinforcing elements embedded in the studs and having upper end portions thereof embedded in the roof overhang.

12. A building structure as defined in claim 11 and further having a cast concrete joint interconnecting the module and the facade wall.

13. A building structure including a building module comprising four upright side walls and a roof integrally cast of concrete, the side walls being joined at corners and each having a series of spaced studs projecting from its outer surface, separately formed facade walls covering at least two adjoining side walls of the module and each having a series of spaced upright studs interleaved with the studs of the side walls, the facade walls having portions projecting beyond the corner of the covered side walls of the module and providing a vertical cavity at said corner, and cast concrete infilling said cavity and providing a structural post element at said corner.

14. A building structure as defined in claim 13 in which the structure defined in claim 13 is duplicated in superimposed congruent relationship to provide a multi-story building structure having superimposed structural post elements at the corresponding corners of each story.

15. A building structure including at least two building modules each comprising four upright side walls and a roof integrally cast of concrete, the side walls of each module being joined at corners and each having a series of spaced upright studs projecting from its outer surface, the modules being positioned with side walls thereof in congruent face-to-face relation and with the studs thereof interleaved, facade walls covering at least one of the side walls of each module ajoining those which are in face-to-face relation and each of the facade walls having a series of spaced upright studs interleaved with the studs of the side wall covered by the facade wall, the adjacent edges of the facade walls being extended to provide a vertical cavity adjacent said corners, and cast concrete infilling said cavity and providing a vertical post element adjacent said corners of the modules.

16. A building as defined in claim 15 in which each facade wall and its series of studs are integrally cast of concrete.

17. A building structure including at least four building modules each comprising four upright side walls and a roof integrally cast of concrete, the roof having a planar top surface and the side walls of each module being joined at corners and each having a series of spaced upright studs of greater thickness than the wall portions between the studs and projecting from the outer surfaces of the side walls, the modules being positioned with four corners adjacent to each other and with pairs of side walls thereof in congruent face-to-face relation and with the studs thereof interleaved, the studs of the series of each wall being spaced from said corners to provide a vertical cavity adjacent to said corners, and cast concrete infilling said cavity to provide a structural post adjacent to said adjacent corners.

18. A building structure including at least two building modules each comprising four upright side walls and a roof integrally cast of concrete, the roof having a planar top surface and having edges projecting outwardly beyond the side walls, the side walls being joined at vertical corners and the roof and side walls being joined at horizontal corners, said modules being positioned with side walls in congruent face-to-face relation, portions of the integrally cast concrete of the modules having surfaces along the adjacent horizontal corners defining a horizontal cavity underlying adjacent outwardly projecting edges of the roof, and cast concrete infilling said cavity to provide a horizontal structural beam extended along adjacent horizontal corners.

19. A building structure as defined in claim 18 in which portions of the integrally cast concrete of the modules have surfaces adjacent the vertical corners defining vertical cavities adjacent each end of the adjacent horizontal corners of the modules, and cast concrete infilling said vertical cavities to provide vertical structural post elements adjacent each end of said horizontal structural beam.

20. A building structure as defined in claim 18 and further including a duplicate of the structure defined in claim 21 positioned in superimposed congruent relationship to provide a multi-story building structure and further in which the surfaces defining the horizontal cavity and the infilling cast concrete are of greater cross section for a lower story of the building structure than for an upper story thereof.

21. A building structure as defined in claim 19 and further including a duplicate of the structure defined in claim 22 positioned in superimposed congruent relationship to provide a multi-story building structure having structural post elements in vertically aligned relationship.

22. A building structure including a building module comprising four upright side walls and a roof integrally cast of concrete, the side walls being joined at corners and each having a series of spaced upright studs projecting from its outer surface, facade walls covering at least two adjoining side walls of the module and each having a series of spaced upright studs interleaved with the studs of the side walls of substantially the same height as the side walls of the module and the facade walls having portions projecting beyond the corner of the covered side walls with interengaging surfaces providing a slip joint to accommodate expansion and contraction of the facade walls with respect to other joints of the structure.

23. A building module comprising four upright side walls and a roof integrally cast of concrete, the side walls being joined at corners and each having a series of equally spaced upright studs of greater thickness than the wall portions between the studs and projecting from the outer surfaces of the side walls and each having a flat surface at its outer edge, the stud at one end of the series for each wall being spaced from the adjacent corner of the module a distance greater than the spacing of the stud at the other end of the series from the corner of the module adjacent said other end, thereby providing for interfitting of the studs of one side wall of the module with the studs of a side wall of a similar module and with the flat surfaces of the studs in surface engagement with side wall surfaces when such side walls are congruently positioned with relation to each other, and each stud having inclined side faces positioned to interengage with inclined side faces of studs of a side wall of a similar module when such side walls are congruently positioned with relation to each other.

24. A building module comprising four upright side walls and a roof integrally cast of concrete, the side walls being joined at corners and each having a series of equally spaced upright studs of greater thickness than the wall portions between the studs and projecting from the outer surfaces of the side walls and each having a flat surface at its outer edge, the stud at one end of the series for each wall being spaced from the adjacent corner of the module a distance greater than the spacing of the stud at the other end of the series from the corner of the module adjacent said other end, thereby providing for interfitting of the studs of one side wall of the module with the studs of a side wall of a similar module and with the flat surfaces of the studs in surface engagement with side wall surfaces when such side walls are congruently positioned with relation to each other, the side faces of the studs being positioned to provide clearance between studs of such congruently positioned side walls of similar modules.

25. A building module comprising four upright side walls and a roof integrally cast of concrete, the side walls being joined at corners and each having a series of equally spaced upright studs of greater thickness than the wall portions between the studs projecting from the outer surfaces of the side walls, a doorway formed in a wall between adjacent studs, the stud at one end of the series for each wall being spaced from the adjacent corner of the module a distance greater than the spacing of the stud at the other end of the series from the corner of the module adjacent said other end, thereby providing for interfitting of the studs of one side wall of the module with the studs of a side wall of a similar module when such side walls are congruently positioned with relation to each other, and a door frame cast integrally with the modules around the doorway.

* * * * *

UNITED STATES PATENT AND TRADEMARK OFFICE

CERTIFICATE OF CORRECTION

PATENT NO. : 4,019,293

DATED : April 26, 1977

INVENTOR(S) : Eduardo Santana Armas

It is certified that error appears in the above-identified patent and that said Letters Patent are hereby corrected as shown below:

Column 12 - (In Claim 23) - Line 9 - after "the stud" insert --at each end of the series on each of the four side walls being spaced from the end of that wall and the stud--.

Column 12 - (In Claim 23) - Line 10 - after "each" insert --of the four side--, and change "wall" to read --walls--.

Column 12 - (In Claim 23) - Line 15 - before "side wall" change "a" to read --any--.

Column 12 - (In Claim 24) - Line 29 - after "the stud" insert --at each end of the series on each of the four side walls being spaced from the end of that wall and the stud--.

UNITED STATES PATENT AND TRADEMARK OFFICE

CERTIFICATE OF CORRECTION

PATENT NO. : 4,019,293

DATED : April 26, 1977

INVENTOR(S) : Eduardo Santana Armas

It is certified that error appears in the above-identified patent and that said Letters Patent are hereby corrected as shown below:

Column 12 - (In Claim 24) - Line 30 - after "each" insert --of the four side--, and change "wall" to read --walls--.

Column 12 - (In Claim 24) - Line 35 - before "side wall" change "a" to read --any--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*